US008041277B2

(12) United States Patent
Hashimoto et al.

(10) Patent No.: US 8,041,277 B2
(45) Date of Patent: Oct. 18, 2011

(54) IMAGE FORMING APPARATUS

(75) Inventors: Yasushi Hashimoto, Ibaraki (JP); Motoji Kurobane, Ibaraki (JP); Masami Takeshita, Ibaraki (JP); Kazuhiko Kawasaki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 205 days.

(21) Appl. No.: 12/357,701

(22) Filed: Jan. 22, 2009

(65) Prior Publication Data

US 2009/0190941 A1 Jul. 30, 2009

(30) Foreign Application Priority Data

Jan. 25, 2008 (JP) ..... 2008-014324
Jan. 25, 2008 (JP) ..... 2008-014326

(51) Int. Cl.
*G03G 15/00* (2006.01)

(52) U.S. Cl. ..... 399/322; 399/43; 399/68; 399/400

(58) Field of Classification Search ..... 399/43, 399/322, 68, 67, 400, 45
See application file for complete search history.

(56) References Cited

U.S. PATENT DOCUMENTS

| | | | | |
|---|---|---|---|---|
| 4,378,152 | A * | 3/1983 | Edwards et al. | 399/322 |
| 2003/0161649 | A1 * | 8/2003 | Yoshikawa et al. | 399/68 |
| 2006/0120738 | A1 * | 6/2006 | Bartley et al. | 399/45 |

FOREIGN PATENT DOCUMENTS

| | | | |
|---|---|---|---|
| JP | 58-10457 | | 1/1983 |
| JP | 63274979 | A * | 11/1988 |
| JP | 63-50668 | | 12/1988 |
| JP | 2-24130 | | 7/1990 |
| JP | 6-95542 | | 4/1994 |
| JP | 10-63137 | | 3/1998 |
| JP | 2001-343877 | | 12/2001 |
| JP | 2006-91448 | | 4/2006 |

* cited by examiner

*Primary Examiner* — Constantine Hannaher
(74) *Attorney, Agent, or Firm* — Oblon, Spivak, McClelland, Maier & Neustadt, L.L.P.

(57) ABSTRACT

An image forming apparatus includes a guide member configured to guide a sheet to a nip section between a heating roller and a pressing roller disposed close to the upstream side of the rollers and on the pressing roller side. A downstream end of the guide member is disposed on the heating roller side with respect to the nip surface between the rollers so that a header of the sheet to be printed is in contact with the heating roller first, and a downstream end of the fixing device introduction guide member is concavely curved.

8 Claims, 6 Drawing Sheets

IMAGE FORMING APPARATUS

CROSS-REFERENCE TO RELATED APPLICATIONS

The present application claims priority under 35 U.S.C. §119 to Japanese Patent Application Publication Nos. 2008-014324, filed Jan. 25, 2008 and 2008-014326, filed Jan. 25, 2008, the entire contents of which are hereby incorporated herein by reference.

BACKGROUND OF THE INVENTION

1. Field of the Invention

The present invention generally relates to an image forming apparatus such as a printer and a copier. More particularly, the present invention relates to an image forming apparatus including a photosensitive body, a transferring device, and a fixing device, the transferring device being configured to transfer a toner image developed on the photosensitive body onto an image recording member, and the fixing device being configured to fix the toner image transferred onto the image recording member by heating and pressing.

2. Description of the Related Art

Conventionally, in a fixing device configured to heat and fix a toner image on the image recording member, a thermal roller method is generally employed. FIG. 1 schematically shows a general configuration of a fixing device 9 and a feeding mechanism nearby the fixing device 9 for feeding an image recording member in a conventional electrophotographic type image forming apparatus.

As shown in FIG. 1, the fixing device 9 includes a heating roller 9*a* and a pressing roller 9*b*. The heating roller 9*a* includes heating means (not shown) such as a halogen lamp within the heating roller 9*a*. The heating roller 9*a* generally includes a core bar having a cylindrical shape and a fluorine resin layer or a silicon rubber layer coated on the core bar for improving the releasing characteristics of toner. As the fluorine resin, PFA tubing may be used or PFA may be applied and baked. The pressing roller 9*b* generally includes a core bar, a heat-resistant silicon rubber layer formed on the core bar as an elastic body layer, and a PFA tubing layer having excellent releasing characteristics wound on the surface of the elastic body layer.

The heating roller 9*a* and the pressing roller 9*b* constituting a fixing roller pair are pressed to each other by pressing means (not shown) using a spring, so that the contacting surface between the heating roller 9*a* and the pressing roller 9*b* forms a surface due to deformation of the elastic body layer of the pressing roller 9*b*. Herein, this contacting surface is called a nip section. While the nip section (contacting surface) is being formed, the heating roller 9*a* and the pressing roller 9*b* are driven to rotate in a predetermined direction by fixing roller pair driving means and roller driving control means.

By conducting a known electrophotographic process, a toner image visualized on a photosensitive drum 6 is transferred onto a sheet (herein may be referred to as an image recording member) 22 by a transferring device 8. Then, the sheet 22 is fed through a sheet feeding path 12 to the nip section between the heating roller 9*a* and the pressing roller 9*b*. The fixing device 9 further includes a fixing device introduction guide member 16 configured to guide the sheet 22 to the nip section. The fixing device introduction guide member 16 is formed so that a downstream end of the fixing device introduction guide member 16 is formed in a straight line on the same plane. By following a series of processes as described above, the toner image formed on the sheet 22 is heated and pressed by the heating roller 9*a* and the pressing roller 9*b* so that the toner image is fixed onto the sheet 22.

Unfortunately, in such a fixing device using the thermal roller method, when a thin image recording member (sheet) having high moisture content is used to be printed, the moisture in the image recording member may evaporate because the image recording member is rapidly heated. As a result, the image recording member thermally shrinks, thereby causing a deformation of the image recording member, which may result in developing wrinkles. To overcome the problem, there has been generally adopted a method of preventing wrinkles in which the shape of the heating roller is modified to have a so-called reverse-crown shape so that the center portion of the heating roller becomes thinner than the end portions of the heating roller. By configuring this way, the distortion of the pressing roller at end portions of the image recording member in the width direction (orthogonal to the feeding direction of the image recording member) becomes greater than that at the center portion of the image recording member. Therefore, in the nip section, the image recording member is pushed toward the end portions in the width direction to prevent wrinkles.

Further, Patent Document 1 proposes a technique in which the guide member for guiding the image recording member to the nip section is configured so that the center portion of the guide member is higher than both end portions in the width direction, and accordingly, the center portion of the guide member is closer to the heating roller than the both end portions. By configuring the guide member in this manner, it becomes possible to prevent the both side ends of the image recording member from approaching the center portion of the image recording member. Further, because of the configuration of the guide member, the image recording member is in contact first with the heating roller before being fed into the nip section. As a result, the image recording member is bent in a short curve by the guide member and the heating roller, and a downstream end section in the feeding direction of the image recording member becomes rigid, which helps to maintain a flatness of the image recording member and prevent wrinkles.

Further, Patent Document 2 proposes a technique in which, the shape of the downstream end of the guide member in the height direction is configured to correspond to the shape of an entrance portion of the nip section between the heating roller and the pressing roller. In other words, the center portion of the downstream end of the guide member is higher than end portions of the guide member in the width direction so that the shape of the downstream end of the guide member in the height direction is substantially equal to the reverse-crown shape which is the shape of the entrance portion of the nip section. By configuring this way, the image recording member may be uniformly fed into the nip section to prevent wrinkles.

Further, Patent Document 3 discloses a technique in which the guide member is configured so that the downstream end portion of the guide member includes a lower plane part in the center section and higher plane parts on both sides of the lower plane part in the width direction. The fixing device is provided as a film heating and fixing device including a heating roller and a pressing roller. The heating roller includes a heater and a heat-resistant endless film. The pressing roller includes an elastic body layer made of silicon rubber or the like. In the above documents, by making the shape of the image recording member correspond to the concave shape in the height direction, the end sections of the image recording member in the width direction enter first into the nip section. Therefore, the image recording member is pushed toward the end portions in the width direction, which may effectively prevent wrinkles caused due to a folded portion in the center portion of the image recording member. In the techniques proposed in this document, as described above, the end portions of the image recording member in the width direction are higher than the center portion of the image recording member so that the ends portion of the image recording member enter into the nip section first. To achieve this, from a geometric point of view, the downstream end of the guide member should be lower than a plane including the nip section (nip plane). This configuration of Patent Document 3 is upside-down compared to the configuration of Patent Document 1 where the center portion of the guide member for guiding the image recording member into the nip section is higher than the ends portion of the guide member in the width direction. Therefore, the technique disclosed in Patent Document 3 as a wrinkle prevention technique may be regarded as an extension of the technique disclosed in Patent Document 1.

According to the descriptions disclosed in Patent Documents 1 through 3, wrinkles of the image recording member may be prevented by optimizing the shape of the downstream end of the image recording member when the image recording member is to be fed into the nip portion. However, in electrophotographic type image forming apparatuses, there are many cases where so-called cut sheets are used as the image recording member; in most of these cases, the image recording members are obliquely fed (skew-fed) into the fixing device. Therefore, even if the image forming apparatus employs any of the techniques described above, the downstream end of the image recording member is not always fed into the nip section as it is assumed in the descriptions. On the other hand, when the image recording members are "skew-fed" into the nip section, there is a quite high probability of wrinkles occurring. Therefore, any technique described above alone may not be enough to reduce the wrinkles. To reduce wrinkles of the image recording member, the fixing roller is required to have the reverse-crown shape. However, when the angle of the reverse-crown shape is too large, the image recording member may be excessively pushed toward the end portions in the width direction in the nip section. In this case, the downstream side of the image recording member may be deformed, which may cause waves of the image recording member in the direction orthogonal to the plane of the image recording member on the surface of the image recording member. When the wavy image recording member is fed into the nip section, due to misaligned contact with the fixing roller, the toner image transferred onto the image recording member may be disturbed, thereby causing image disturbance.

It is known from prior art that even when the downstream end of the guide member is in a straight line having a constant height and the image recording member is somewhat skew-fed, by setting a diameter size of the reverse-crown of the heating roller to be about 200 μm, setting the width of the nip section equal to or more than 10 mm without becoming narrower in the sheet feeding direction, and setting the downstream end of the guide member higher than the nip plane so that the guide member becomes closer to the heating roller with respect to the nip plane, wrinkles may be reduced in most cases. Further, by configuring this way, even when a wide-size sheet such as an A3 size sheet and a longer-sized sheet such as a ledger sheet are used, the disturbance of an image due to the reverse-crown of the heating roller may be reduced.

On the other hand, recently, more and more so-called thick coat papers and preprint papers have been widely used as the image recording member in electrophotographic type image forming apparatuses in such as direct mail (DM) marketing due to increasing Print On Demand. Further, there is also a growing demand for using image recording members (sheets) having a larger size and a lower weight due to increasing Book On Demand in publishing markets. For example, in Japan, when an A5 size book is produced, an extended size of sheet larger than a thin A3 size sheet and having a basis weight of 60 g/m$^2$ may be used so that four pages of document content are printed on each of both sides of the sheet, i.e., in total, eight pages of document content are printed on the single sheet. In some areas outside Japan, when manuals of products are produced, four pages of document content are printed on each of both sides of a sheet having a basis weight of 75 g/m$^2$ and size 14 inches (355.6 mm)×18 inches (457.2 mm). In such a case where a thin and large sheet is to be printed, the rigidness of the sheet may become lower and also the influence of the distortion of the nip portion may become larger. Therefore, the image distribution due to the reverse-crown is more likely to be remarkable in appearance. This phenomenon may be reduced by reducing the amount of reverse-crown, but if the amount of reverse-crown is reduced, the margin against the wrinkles may be relatively reduced.

Patent Document 1: Japanese Utility Model Application Publication No.: S56-130954

Patent Document 2: Japanese Patent Application Publication No.: H6-95542

Patent Document 3: Japanese Patent Application Publication No.: 2006-91448

SUMMARY OF THE INVENTION

According to an aspect of the present invention, an image forming apparatus may resolve at least one of the above problems and enable to reduce wrinkles in fixing an image (fixing wrinkles) without the image being disturbed even when a thin and large-size sheet is printed.

According to an aspect of the present invention, there is provided an image forming apparatus capable of reducing wrinkles in fixing an image without disturbing the image at a lower cost.

According to an aspect of the present invention, there is provided an image forming apparatus capable of increasing a margin against the image disturbance and wrinkles occurring in a fixing process.

According to an aspect of the present invention, an image forming apparatus includes a photosensitive body; a transferring device configured to transfer a toner image developed on the photosensitive body onto an image recording member; a fixing device including a heating roller and a pressing roller, the fixing device being configured to fix the toner image transferred on the image recording member onto the image recording member by heating and pressing; and a fixing device introduction guide member configured to guide the image recording member to a nip section between the heating roller and the pressing roller of the fixing device. The image forming apparatus is characterized in that the fixing device introduction guide member is disposed close to the upstream side of the heating roller and the pressing roller and on the pressing roller side, a downstream end of a guiding surface of the fixing device introduction guide member in a feeding direction of the image recording member is disposed on the heating roller side with respect to the nip surface orthogonal to a straight line between the center of the heating roller and the center of the pressing roller, the nip surface including a nip section between the heating roller and the pressing roller, so that a downstream end of the image reading member guided by the fixing device introduction guide member is in first contact with the heating roller, and a downstream end of the guiding surface of the fixing device introduction guide member is curved so that a center portion of the downstream end of the guiding surface of the fixing device introduction guide member is disposed on the upstream side with respect to both ends of the downstream end of the guiding surface of the fixing device introduction guide member.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

Figure 3:
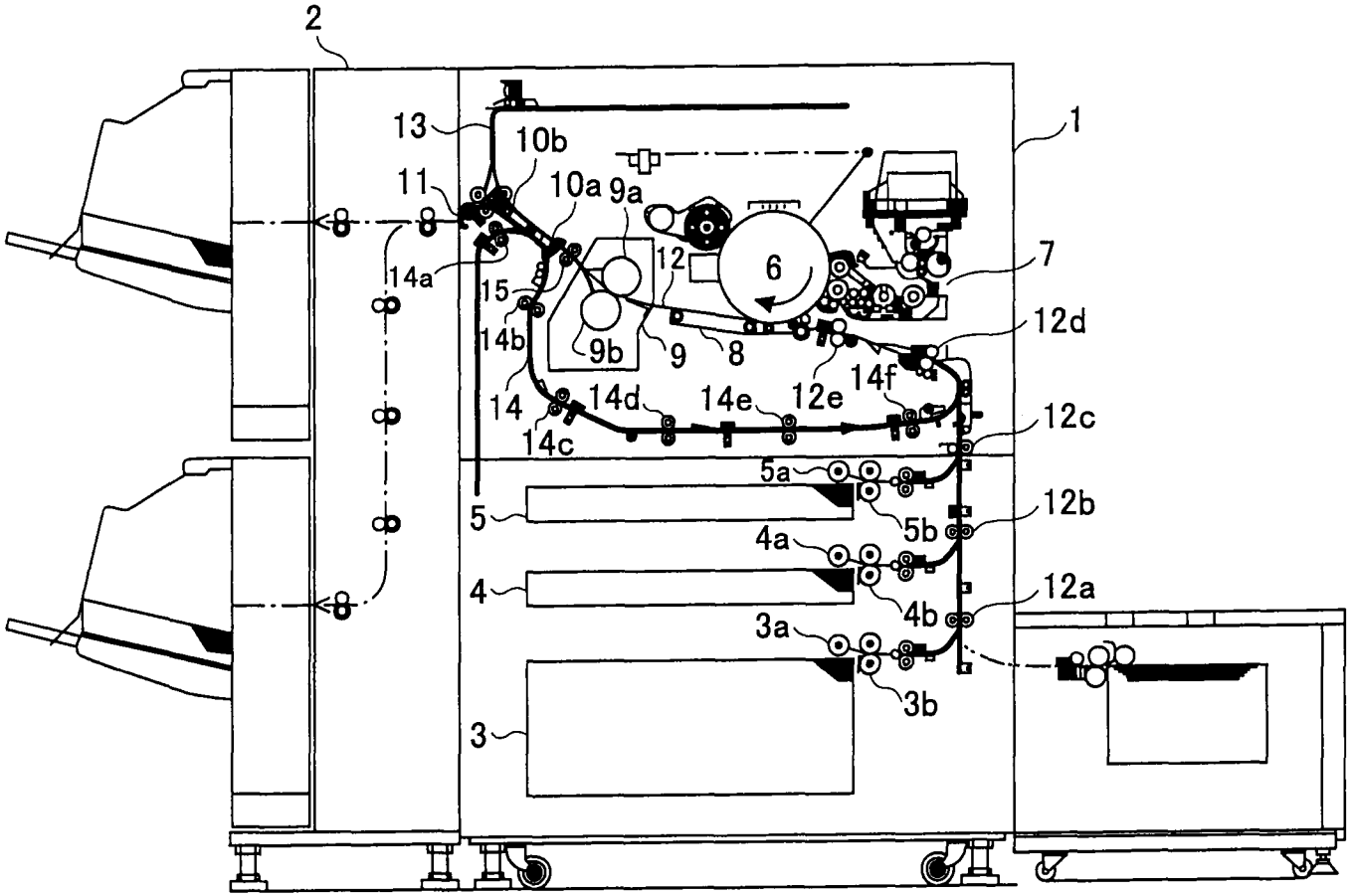
FIG. 3 is a drawing showing an example of a whole configuration of an image forming apparatus system including an image forming apparatus according to an embodiment of the present invention.

In the following, embodiments of the present invention are described with reference to the accompanying drawings. FIG. 3 shows an example of a whole configuration of an image forming apparatus system. As shown in FIG. 3, the image forming apparatus system includes an image forming apparatus 1 and a sheet handling apparatus 2. In the embodiments of the present invention, the image forming apparatus 1 is a laser printer having a photosensitive body and recording and forming a toner image onto an image recording member by a known electrophotographic process. Further, as the sheet handling apparatus 2, a stacker is used that piles and holds the sheets ejected from the printer 1 onto a tray.

As shown in FIG. 3, the printer 1 includes image recording member containers 3, 4, and 5 containing sheets as the image recording members, and a photosensitive drum 6 to be rotated in the arrow direction based on a signal from a controller (not shown). When the photosensitive drum 6 starts rotating, the surface of the photosensitive drum 6 is uniformly charged by a corona charger (not shown). On the surface of the photosensitive drum 6, an electrostatic latent image is formed by a laser beam emitted from a exposure device (not shown). Upon reaching the front of a developing device 7, the electrostatic latent image is developed by toner and visualized on the surface of the photosensitive body 6 as a toner image. The toner image formed by the known electrophotographic process is transferred by a transferring device 8 onto a sheet fed from the image recording member containers 3, 4, and 5 or through a returning path 14. According to the embodiments of the present invention, the printer 1 further includes a fixing device 9, gates 10*a* and 10*b*, an inverter 13, and a feeding roller pair 15. The fixing device 9 includes a heating roller 9*a* and a pressing roller 9*b*. The heating roller 9*a* and the pressing roller 9*b* press to each other so as to fix the transferred toner image onto the fed sheet. The gates 10*a* and 10*b* switch the feeding direction of the sheet. The inverter 13 performs switchback inversion with respect to a sheet to be ejected, namely, changes the ejection direction of the sheet.

Herein, as a sheet transportation path formed in the printer 1, for convenience, a path 12 extending from the image recording member containers 3, 4, and 5 to a sheet ejection outlet 11 of the printer 1 through the elements 6, 7, and 8 for image forming is called a "sheet feeding path". On the other hand, a path 14 is herein called a "returning path". As shown in FIG. 3, the returning path 14 extends from the gate 10*a* where it is separated from the sheet feeding path 12 to a point which is located at an upstream side with respect to the elements 6, 7, and 8 for image forming so that the returning path 14 rejoins the sheet feeding path 12. The feeding roller pair 15 is disposed on the upstream side with respect to the gates 10*a* and 10*b*.

Further, as shown in FIG. 3, reference numerals 3*a*, 4*a*, and 5*a* denote pickup rollers configured to pick up sheets contained in the image recording member containers 3, 4, and 5, respectively. Reference numerals 3*b*, 4*b*, and 5*b* denote sheet feeding roller pairs which are generally known roller pairs having a feeding roller and a retard roller. The sheet feeding roller pairs 3*b*, 4*b*, and 5*b* supply the sheets one by one to the sheet feeding path 12, while preventing plural sheets from being fed at the same time, the sheets being picked up by the pickup rollers 3*a*, 4*a*, and 5*a*.

The reference numerals 12*a*, 12*b*, and 12*c* denote conveying roller pairs configured to convey the sheets along the sheet feeding path 12. Reference numeral 12*d* denotes a timing roller pair disposed on the upstream side with respect to a resist roller pair 12*e* and configured to supply the sheets to the resist roller pair 12*e*. The resist roller pair 12*e* is configured to supply a sheet in synchronization with a timing when the toner image formed on the photosensitive drum 6 is transferred to the sheet. The reference numerals 14*a*, 14*b*, 14*c*, 14*d*, 14*e*, and 14*f* denote the conveying roller pairs configured to feed the sheets along the returning path 14.

Figure 1:
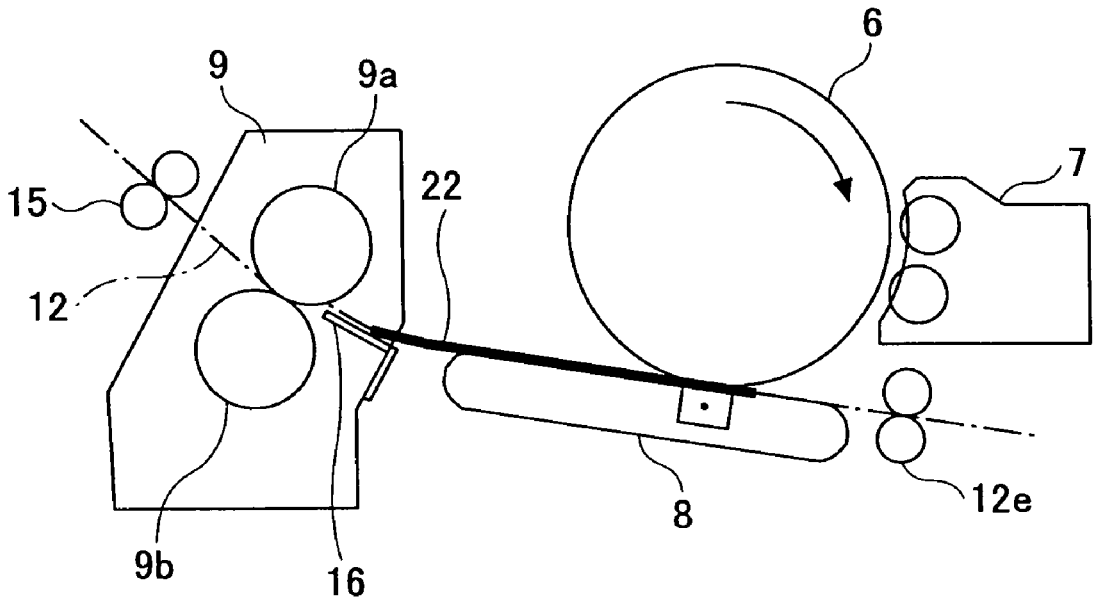
FIG.1 PRIOR ART
FIG. 1 is a drawing schematically showing a fixing device and other nearby devices in a conventional electrophotographic type image forming apparatus.
Figure 2:
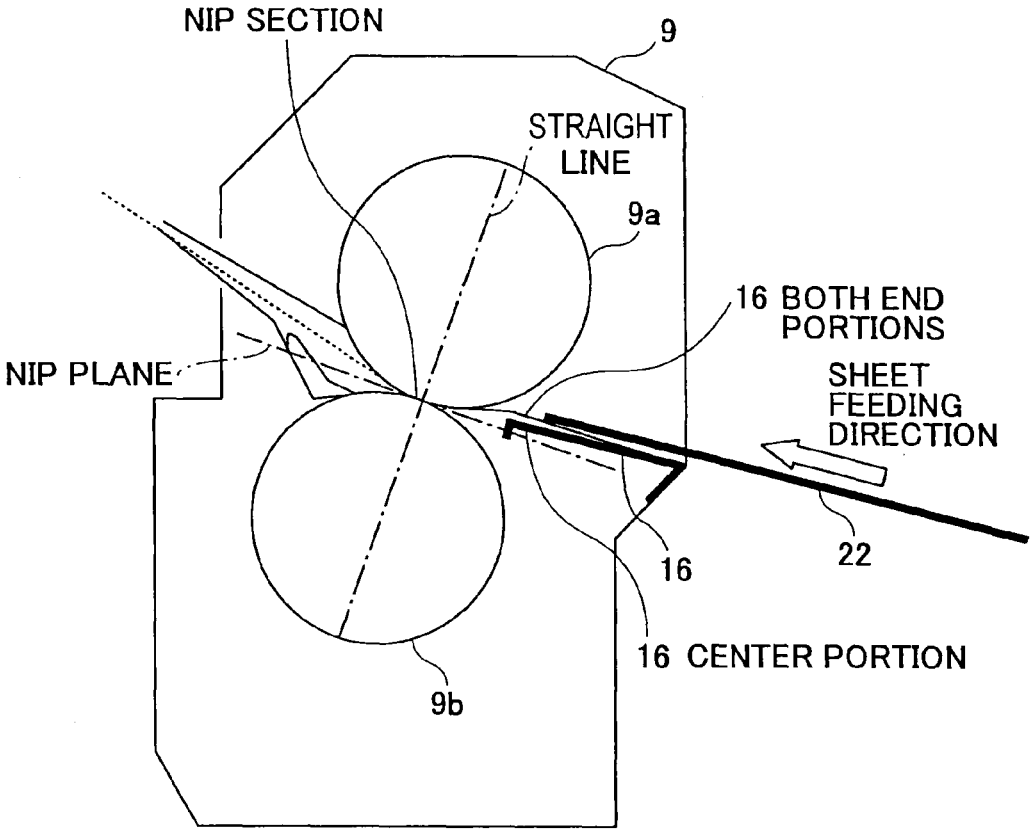
FIG. 2 is a drawing schematically showing a fixing device according to an embodiment of the present invention.

Next, a configuration of a fixing device introduction guide member 16 which is a characteristic feature of the embodiments of the present invention is described with reference to FIGS. 2, and 4A. FIG. 2 schematically shows a configuration of a fixing device according to an embodiment of the present invention.

As shown in FIG. 2, the fixing device 9 includes a heating roller 9*a* and a pressing roller 9*b*. The heating roller 9*a* includes heating means (not shown) such as a halogen lamp within the heating roller 9*a*. Further, the heating roller 9*a* generally includes a core bar having a cylindrical shape and a fluorine resin layer or a silicon rubber layer coated on the core bar to improve toner releasing characteristics. As the fluorine resin, PFA tubing may be used or PFA may be applied and baked. Further, the heating roller 9*a* has a so-called reverse-crown shape in which the center portion is thinner than the end portions in the longitudinal direction of the heating roller 9*a*. The pressing roller 9*b* generally includes a core bar, a heat-resistant silicon rubber layer formed on the core bar as an elastic body layer, and a PFA tubing layer having excellent toner releasing characteristics wound on the surface of the elastic body layer. The heating roller 9*a* and the pressing roller 9*b* constituting a fixing roller pair are pressed to each other by pressing means (not shown) using a spring, so that the contacting area between the heating roller 9*a* and the pressing roller 9*b* becomes a plane surface due to deformation of the elastic body layer of the pressing roller 9*b*. Herein, this contacting surface is called a nip section. While the nip section is being formed, the heating roller 9*a* and the pressing roller 9*b* are driven to rotate in a predetermined direction by a known fixing roller pair driving means and a known roller driving control means.

By using a known electrophotographic process, a toner image visualized on a photosensitive drum 6 is transferred onto a sheet (an image recording member) 22 by the transferring device 8. Then, the sheet 22 is fed through the sheet feeding path 12 to the nip section between the heating roller 9*a* and the pressing roller 9*b*. The fixing device 9 further includes the fixing device introduction guide member 16 configured to guide the sheet 22 to the nip section. As shown in FIGS. 2 and 4A, the fixing device introduction guide member 16 is formed so that a downstream end of the fixing device introduction guide member 16 is disposed to the heating roller 9*a* side with respect to a nip plane formed between the heating roller 9*a* and the pressing roller 9*b*, the nip plane being orthogonal to a straight line drawn between the center of the heating roller 9*a* and the center of the pressing roller 9*b*. By configuring this way, the fixing device introduction guide member 16 guides the sheet 22 to the nip section. By following a series of processes as described above, the toner image formed on the sheet 22 is heated and pressed at the nip section between the heating roller 9*a* and the pressing roller 9*b* to be fixed onto the sheet 22

Figure 4A:
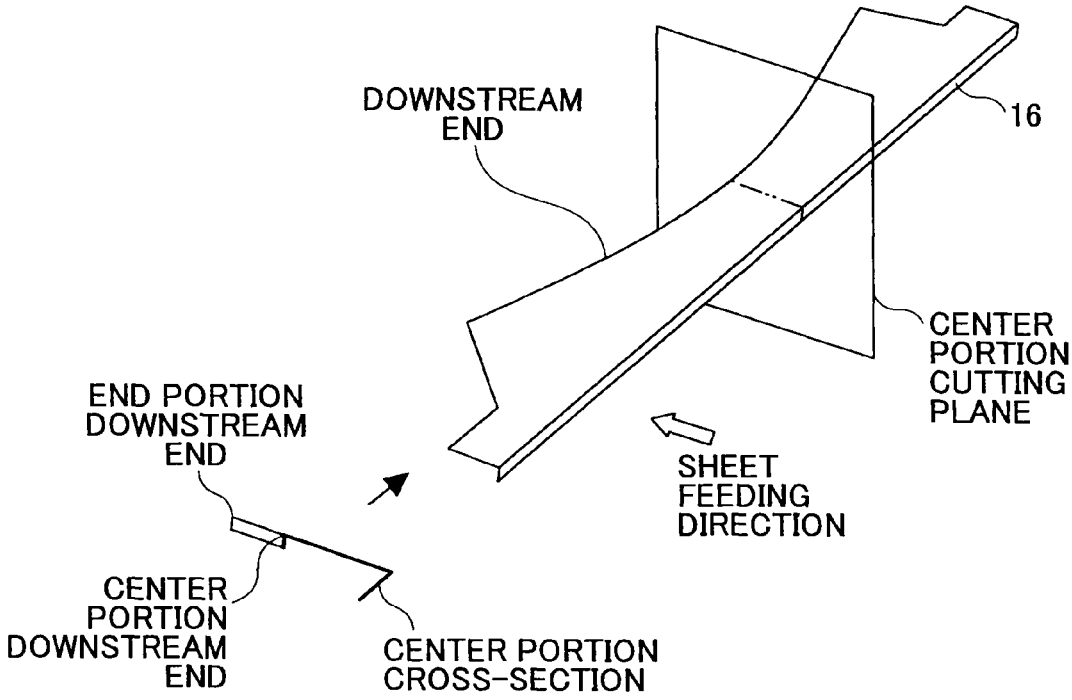
FIG. 4A is a drawing showing a fixing device introduction guide member according to an embodiment of the present invention.
Figure 5:
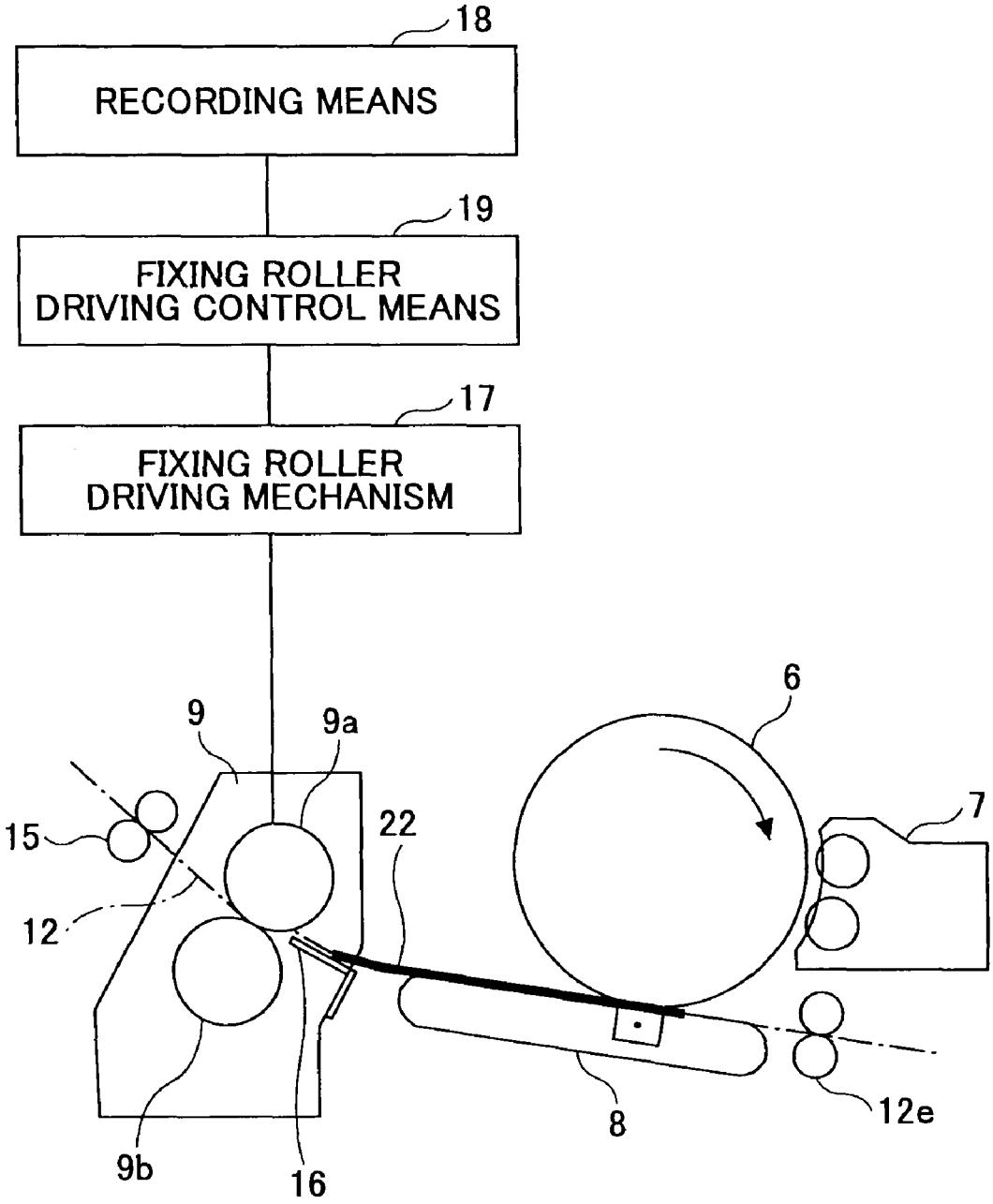
FIG. 5 is a drawing schematically showing a driving method of driving the fixing device according to an embodiment of the present invention.

FIG. 4A shows an exterior of the fixing device introduction guide member 16 according to an embodiment of the present invention. As shown in FIG. 4A, the downstream end of the fixing device introduction guide member 16 is disposed to the heating roller 9*a* side with respect to a nip plane formed between the heating roller 9*a* and the pressing roller 9*b*, the nip plane being orthogonal to the straight line drawn between the center of the heating roller 9*a* and the center of the pressing roller 9*b*. Further, the center portion of the downstream end of the fixing device introduction guide member 16 is concave with respect to both end portions of the downstream end and toward the upstream side in the sheet guiding direction on the upper surface (guiding surface) of the fixing device introduction guide member 16. In other words, the center portion of the downstream end of the fixing device introduction guide member 16 is disposed on the upstream side with respect to both the end portions of the downstream end of the fixing device introduction guide member 16. FIG. 5 shows an exemplary configuration where the fixing device introduction guide member 16 is disposed in the fixing device 9. In this case, the center portion of the downstream end of the guiding surface (upper surface of the fixing device introduction guide member 16) is curved toward the upstream side with respect to both end portions of the downstream end of the fixing device introduction guide member 16. As a result, in the center portion of the sheet 22, a lifted amount (height) of the sheet 22 from the fixing device introduction guide member 16 is reduced due to the curved shape of the downstream end of the fixing device introduction guide member 16; therefore it becomes more difficult for the sheet 22 to contact the heating roller 9*a* by that much. In other words, the contact between the sheet 22 and the heating roller 9*a* is delayed by that much due to the curved shape of the downstream end of the fixing device introduction guide member 16.

Figure 4B:
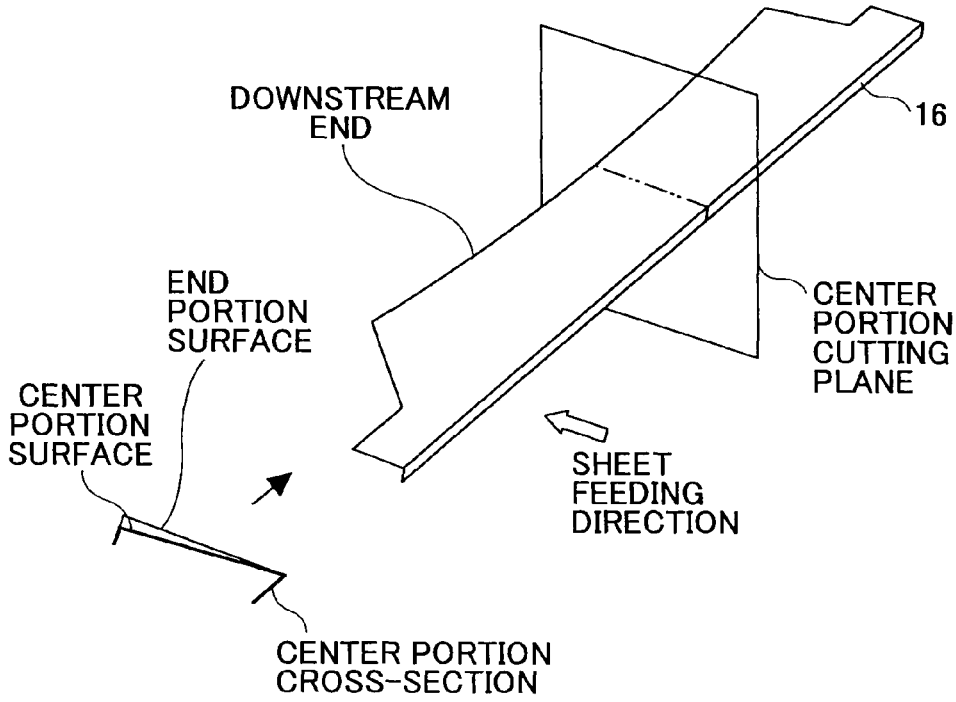
FIG. 4B is a drawing showing another fixing device introduction guide member according to another embodiment of the present invention.

FIG. 4B shows an exterior of the fixing device introduction guide member 16 according to another embodiment of the present invention. As shown in FIG. 4B, the downstream end of the fixing device introduction guide member 16 is curved so that the center portion of the downstream end of the fixing device introduction guide member 16 is disposed on the pressing roller 9*b* side with respect to both the end portions of the downstream end of the fixing device introduction guide member 16. Upon being heated in the nip section, the sheet 22 is dried and shrinks. At the same time, the sheet 22 is deformed by being pushed toward both end sides in the width direction due to the effect of the heating roller 9*a* formed in the reverse-crown shape. Due to the deformation of the sheet 22 in the nip section, waves formed in the direction substantially orthogonal to a feeding surface of the sheet 22 (a surface on which the sheet 22 is fed) may be formed on the upstream side in the sheet 22 with respect to the nip section. However, in this case, the center portion of the downstream end of the guiding surface (upper surface of the fixing device introduction guide member 16) is curved toward the pressing roller 9*b* side (i.e., downward) with respect to both end portions of the downstream end of the fixing device introduction guide member 16. As a result, in the center portion of the sheet 22, a lifted amount (height) of the sheet 22 from the fixing device introduction guide member 16 is reduced due to the curved shape of the downstream end of the fixing device introduction guide member 16; therefore it becomes more difficult for the sheet 22 to contact the heating roller 9*a* by that much. In other words, the contact between the sheet 22 and the heating roller 9*a* is delayed by that much due to the curved shape of the downstream end of the fixing device introduction guide member 16.

Table 1 shows comparison results of occurrence of image distribution on the image recording members (sheets) among the fixing device introduction guide members shown in FIGS. 4A and 4B and a conventional fixing device introduction guide member having a same (single) guiding plane and a straight downstream end when experiments were conducted under the following experimental conditions:

Experimental Conditions 1:

Recording member: size (14 inches×18 inches), basis weight (75 g/cm$^2$), fiber direction (lateral)

Print pattern: print density 50% of halftone

Print mode: two-sided printing

Sheet feeding direction: SEF (Short Edge Feed)

Line speed of fixing roller: 726.4 mm/s (same as that of photosensitive body)

Fixing temperature: 190° C.

Total number of evaluated sheets: 100 sheets

Evaluation method: after 1000 A4 size sheets are printed, 100 evaluation sheets are printed and the number of sheets on which printing disturbance occurs are counted.

Fixing Device Introduction Guide Members

A: conventional fixing device introduction guide member (shape of downstream end: straight)

B: fixing device introduction guide member according to the embodiment of the present invention (shape of downstream end: center portion is concave toward upstream direction, concave amount: 10 mm)

C: fixing device introduction guide member according to the embodiment of the present invention (shape of downstream end: center portion is concave toward upstream direction, concave amount: 20 mm)

D: fixing device introduction guide member according to the embodiment of the present invention (shape of downstream end: center portion is concave toward the pressing roller side, concave amount: 3 mm)

TABLE 1

| | FIXING DEVICE INTRODUCTION GUIDE MEMBER | | | |
|---|---|---|---|---|
| | A | B | C | D |
| NO OF SHEETS ON WHICH PRINTING DISTURBANCE OCCURS | 82 | 49 | 36 | 30 |

As Table 1 shows, the number of printed sheets on which image disturbance occurs is largely reduced when the fixing device introduction guide members B, C, and D are used compared with a case where the fixing device introduction guide members A is used. Further, as a comparison between the fixing device introduction guide members B and C, the larger the concave amount is, the less the image disturbance occurs.

FIG. 5 schematically shows a configuration of elements for a method of driving the fixing device according to an embodiment of the present invention. In FIG. 5, the reference numeral 17 denotes a fixing roller driving mechanism including, for example, a stepper motor and a gear train. The reference numeral 18 denotes recording means configured to record the size and weight of the image recording members. The recording means may include at least one of input means such as an operations panel on which an operator inputs the size and the weight of the image recording member and detecting means configured to detect the size and the weight of the image recording member using sensors provided in a container for containing the recording members and a rewritable memory for storing the size and the weight of the image recording member. The reference numeral 19 denotes known fixing roller driving control means configured to control the rotating speed applied to the fixing roller driving mechanism. More specifically, when a width or a length of the sizes recorded in the recording means 18 for recording the size and weight of the image recording members is greater than a corresponding predetermined value, the fixing roller driving control means changes the line speed of the nip section of the fixing roller pair into a second line speed which is slower than the line speed of the photosensitive body (hereinafter referred to as a processing speed).

Table 2 shows comparison results of occurrence of image distribution on the image recording members (sheets) among the conventional fixing device introduction guide member (shape of downstream end: straight) "A", the fixing device introduction guide member according to the embodiment of the present invention (shape of downstream end: center portion is concave toward upstream direction, concave amount: 20 mm) "C", and fixing device introduction guide member according to the embodiment of the present invention (shape of downstream end: center portion is concave toward the pressing roller side, concave amount: 3 mm) "D" when the controlling method shown in FIG. 5 is used in which the line speed of the fixing roller is reduced in several levels from a reference speed which is substantially the same as the processing speed (726.4 mm/s in this embodiment) (in this case, the line speed of the fixing roller is substantially the same as the processing speed), then the line speed of the fixing roller is reduced by the reduction rate shown in Table 2 under the following experimental conditions:

Experimental Conditions 2:

Recording member: size (14 inches×18 inches), basis weight (75 g/cm$^2$), fiber direction (lateral)

Print pattern: print density 50% of halftone

Print mode: two-sided printing

Sheet feeding direction: SEF (Short Edge Feed)

Line speed of fixing roller: 726.4 mm/s (processing speed as reference), 721.315 mm/s (reduced by 0.7% from the reference), and 719.136 mm/s (reduced by 1.0% from the reference)

Fixing temperature: 195° C.

Total number of evaluated sheets: 100 sheets

Evaluation method: after 1000 A4 size sheets are printed, 100 evaluation sheets are printed and the number of sheets on which printing disturbance occurs are counted.

Fixing Device Introduction Guide Members

A: conventional fixing device introduction guide member (shape of downstream end: straight)

C: fixing device introduction guide member according to the embodiment of the present invention (shape of downstream end: center portion is concave toward upstream direction, concave amount: 20 mm)

D: fixing device introduction guide member according to the embodiment of the present invention (shape of downstream end: center portion is concave toward the pressing roller side, concave amount: 3 mm)

TABLE 2

| | | FIXING DEVICE INTRODUCTION GUIDE MEMBER | | | | | | | | | | |
|---|---|---|---|---|---|---|---|---|---|---|---|---|
| | | A | | | C | | | | D | | | |
| | | MOISTURE CONTENT (%) | | | | | | | | | | |
| | | 5.9 | | | 5.9 | | 6.2 | | 5.9 | | 6.2 | |
| | | LINE SPEED OF FIXING ROLLER | | | | | | | | | | |
| | | REFERENCE | −0.7% | −1.0% | REFERENCE | −0.7% | −0.7% | −1.0% | REFERENCE | −0.7% | −0.7% | −1.0% |
| NO OF SHEETS ON WHICH PRINTING DISTURBANCE OCCURS | FIRST PRINTING SURFACE | 100 | 42 | 72 | 5 | 0 | 0 | 7 | 4 | 0 | 0 | 5 |
| | SECOND PRINTING SURFACE | 92 | 91 | 88 | 15 | 0 | 12 | 36 | 17 | 1 | 10 | 39 |
| | TOTAL | 192 | 133 | 160 | 20 | 0 | 12 | 42 | 21 | 1 | 10 | 44 |

As the results in Table 2 show, the number of sheets on which printing disturbance occurs is better controlled when the line speed of the fixing roller is reduced by 0.7% with respect the processing speed. Further, when this reduction of the line speed is conducted by using the fixing device introduction guide member C and D, the number of sheets on which printing disturbance occurs is largely reduced.

Figure 6:
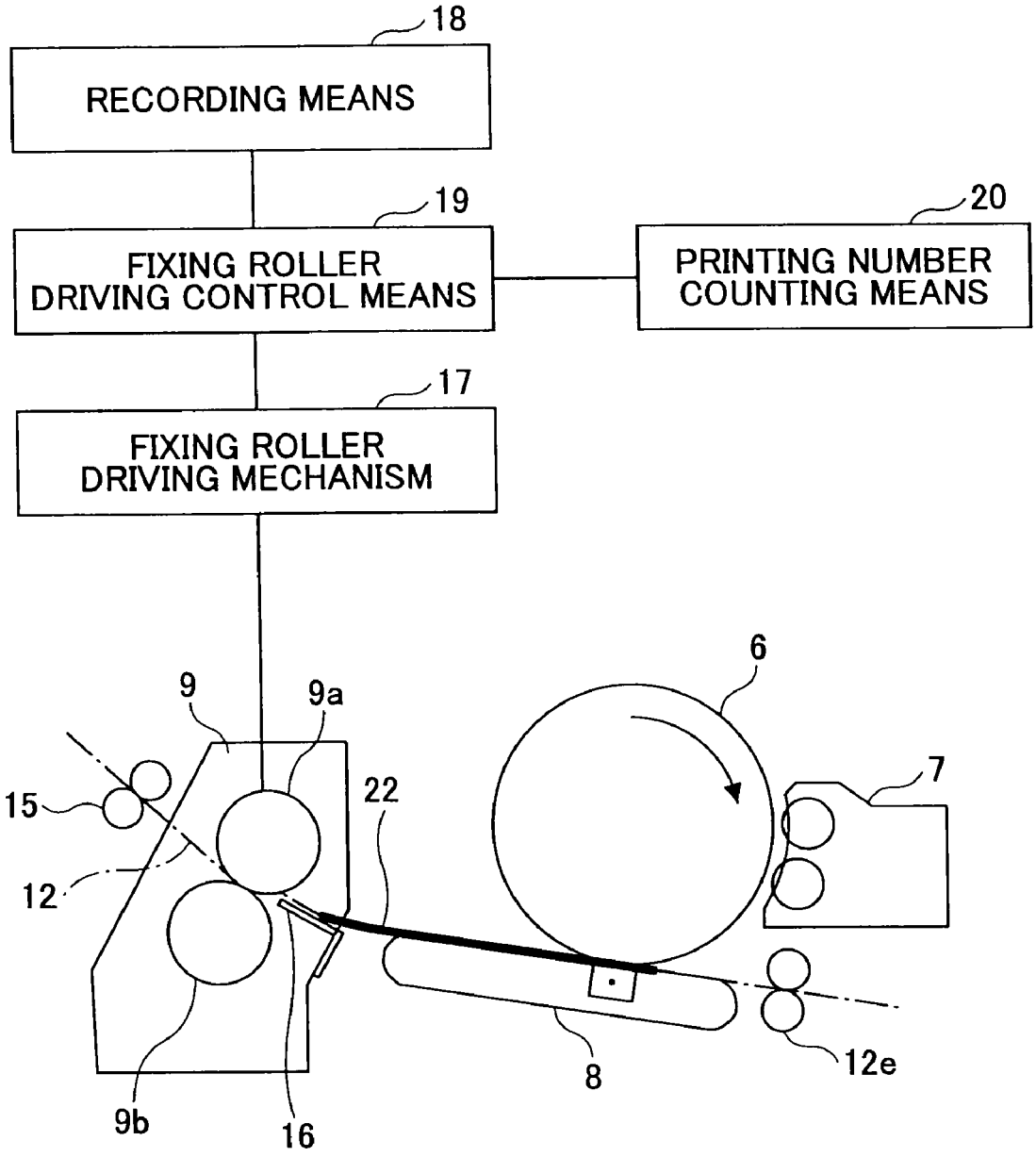
FIG. 6 is a drawing schematically showing another driving method of driving the fixing device according to another embodiment of the present invention.

FIG. 6 schematically shows a configuration of elements for another driving method of driving the fixing device according to an embodiment of the present invention. In FIG. 6, the reference numerals 17 and 18 denote the fixing roller driving mechanism and the recording means, respectively. The reference numeral 20 denotes printing number counting means configured to count the number of printed sheets after printing starts. The reference numeral 19 denotes the fixing roller driving control means configured to control the rotating speed of the fixing roller driving mechanism. In this configuration, when a width or a length of the sizes recorded in the recording means 18 for recording the size and weight of the image recording members is greater than the corresponding predetermined value, and after the number counted by the printing number counting means is greater than a predetermined number, the fixing roller driving control means changes the rotating speed of the fixing roller driving mechanism into a second line speed which is slower than the processing speed.

Table 3 shows the results of experiments in which the number of printed sheets were counted until the first image disturbance occurred on the image recording members "X" and "Y" described below using the conventional fixing device introduction guide member (shape of downstream end: straight) "A" under the following experimental conditions while the line speed of the fixing roller is controlled to be substantially equal to the processing speed.

Experimental Conditions 3:

Recording member "X": size (14 inches×18 inches), basis weight (75 g/cm$^2$), fiber direction (lateral), moisture content (6.1%)

Recording member "Y": size (14 inches×18 inches), basis weight (81.4 g/cm$^2$), fiber direction (vertical), moisture content (6.4%)

Print pattern: print density 50% of halftone

Print mode: two-sided printing

Line speed of fixing roller: 726.4 mm/s (processing speed)

Sheet feeding direction: SEF (Short Edge Feed)

Fixing Device Introduction Guide Members

A: conventional fixing device introduction guide member (shape of downstream end: straight)

Evaluation method: Under the above conditions, consecutive printing is performed and the number of printed sheets is counted until an image disturbance occurs. (Normally, when pages are counted, one page is counted when a sheet feeds 8.5 inches in the feeding direction and each of a first surface and a second surface is counted as one page. However, in this experiment, for convenience, two-sided printing on a single sheet having size of 14 inches×18 inches is counted as four pages.)

TABLE 3

| | RECORDING MEMBER | |
|---|---|---|
| | X | Y |
| FIXING TEMPERATURE (° C.) | 190 | 195 |
| PAGE ON WHICH FIRST PRINTING DISTURBANCE OCCURS | 705 | 916 |

As the results in Table 3 show, the image disturbance may not occur just after the printing starts but may occur after about 700 pages have been printed. On the other hand, generally, when a technique as described in an embodiment of the present invention is used in which the line speed of the fixing roller is reduced, the margin against wrinkles on a thin sheet and a sheet with fibers in the vertical direction may be reduced.

Table 4 shows the results of experiments in which the number of printed sheets were counted until an image blur (which is a prior warning of wrinkle) occurs on the image recording member using the fixing device introduction guide member according to the embodiment of the present invention (shape of downstream end: center portion is concave toward upstream direction, concave amount: 20 mm) "C" and the fixing device introduction guide member according to the embodiment of the present invention (shape of downstream end: center portion is concave toward the pressing roller side, concave amount: 3 mm) "D" under the following experimental conditions while the line speed of the fixing roller is reduced by about 0.7% with respect to the processing speed (i.e., the line speed of the fixing roller is about 721.315 mm/s (0.7% reduced)).

Experimental Conditions 4:

Recording member "X": size (14 inches×18 inches), basis weight (75 g/cm$^2$), fiber direction (lateral), moisture content (6.1%)

Recording member "Y": size (14 inches×18 inches), basis weight (81.4 g/cm$^2$), fiber direction (vertical), moisture content (6.4%)

Print pattern: print density 50% of lateral lines (line width: 2 dots, space width: 4 dots)

Print mode: two-sided printing

Line speed of fixing roller: 726.4 mm/s (processing speed, reference), 721.315 mm/s (reduced by 0.7% from the reference)

Sheet feeding direction: SEF (Short Edge Feed)

Fixing Device Introduction Guide Members

C: fixing device introduction guide member according to the embodiment of the present invention (shape of downstream end: center portion is concave toward upstream direction, concave amount: 20 mm)

D: fixing device introduction guide member according to the embodiment of the present invention (shape of downstream end: center portion is concave toward the pressing roller side, concave amount: 3 mm)

Evaluation method: Under the above conditions, consecutive printing is performed and the number of printed sheets is counted until an image blur (which is a prior warning of wrinkle) occurs. (Normally, when pages are counted, one page is counted when a sheet feeds 8.5 inches in the feeding direction and each of a first surface and a second surface is counted as one page. However, in this experiment, for convenience, two-sided printing on a single sheet having size of 14 inches×18 inches is counted as four pages.)

TABLE 4

| | FIXING DEVICE INTRODUCTION GUIDE MEMBER | | | | | | | |
|---|---|---|---|---|---|---|---|---|
| | C | | | | D | | | |
| | RECORDING MEMBER | | | | | | | |
| | X | | Y | | X | | Y | |
| | FIXING TEMPERATURE (° C.) | | | | | | | |
| | 190 | | 195 | | 190 | | 195 | |
| | LINE SPEED OF FIXING ROLLER | | | | | | | |
| | REFERENCE | −0.7% | REFERENCE | −0.7% | REFERENCE | −0.7% | REFERENCE | −0.7% |
| PAGE ON WHICH FIRST PRINTING DISTURBANCE OCCURS | 0 | 84 | 0 | 72 | 0 | 87 | 0 | 79 |

As the results in Table 4 show, the image blur may start occurring within about the first 100 pages and may not start occurring after about 100 pages have been printed. Based on the results, by setting the line speed of the fixing roller to be substantially equal to the processing speed within about first 100 pages, and reducing the line speed of the fixing roller by 0.7% from the processing speed (namely setting the line speed of the fixing roller to be equal to the second speed), both the number of sheets on which image disturbance occurs and the number of sheets on which image blur occurs may be reduced.

As described above, an image forming apparatus according to an embodiment of the present invention may reduce wrinkles in the fixing process and the image disturbance even when thin A3 size or larger sheets are printed.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teachings herein set forth.

What is claimed is:

1. An image forming apparatus, comprising:

a photosensitive body;

a transferring device configured to transfer a toner image developed on the photosensitive body onto an image recording member;

a fixing device including a heating roller and a pressing roller, the fixing device configured to fix the toner image transferred on the image recording member onto the image recording member by heating and pressing; and a fixing device introduction guide member configured to guide the image recording member to a nip section between the heating roller and the pressing roller of the fixing device, wherein the fixing device introduction guide member is disposed close to the upstream side of the heating roller and the pressing roller and on the pressing roller side, a downstream end of a guiding surface of the fixing device introduction guide member in a feeding direction of the image recording member is disposed on the heating roller side with respect to a nip surface orthogonal to a straight line between the center of the heating roller and the center of the pressing roller, the nip surface including the nip section between the heating roller and the pressing roller, so that a downstream end of the image recording member guided by the fixing device introduction guide member first contacts the heating roller, the downstream end of the guiding surface of the fixing device introduction guide member is curved so that a center portion of the downstream end of the guiding surface of the fixing device introduction guide member is disposed on the upstream side with respect to both lateral ends of the downstream end of the guiding surface of the fixing device introduction guide member, and the downstream end of the guiding surface of the fixing device introduction guide member is a single continuous curve between the both lateral ends of the downstream end of the guiding surface of the fixing device introduction guide member.

2. The image forming apparatus according to claim 1, further comprising:

a recording unit including at least one of a detecting unit configured to detect a sheet feeding tray and a size of the image recording member stacked in the sheet feeding tray and an input unit through which an operator inputs size data of the image recording member, and a rewritable memory configured to store the size data of the image recording member detected by the detection unit or input though the input unit;

a driving unit configured to drive a rotation of a fixing roller pair of the fixing device, the fixing roller pair including the heating roller and the pressing roller, the nip section being formed by pressing the heating roller with the pressing roller; and a control unit configured to control a rotating speed applied to the driving unit so that a line speed of the nip section of the fixing roller pair is substantially equal to a line speed of the photosensitive body, wherein when a width or a length of the size of the image recording member to be used and recorded in the recording unit is greater than a width or a length, respectively, of a predetermined size of the image recording member, the rotating speed applied to the driving unit is controlled so that the line speed of the nip section of the fixing roller pair is changed to a second line speed which is slower than the line speed of the photosensitive body.

3. The image forming apparatus according to claim 1, further comprising:

a recording unit including at least one of a detecting unit configured to detect a sheet feeding tray and a size of the image recording member stacked in the sheet feeding tray and an input unit through which an operator inputs size data of the image recording member, and a rewritable memory configured to store the size data of the image recording member detected by the detection unit or input though the input unit;

a counting unit configured to count a number of printed sheets after a printing starts;

a driving unit configured to drive a rotation of a fixing roller pair of the fixing device, the fixing roller pair including the heating roller and the pressing roller, the nip section being formed by pressing the heating roller with the pressing roller; and a control unit configured to control a rotating speed applied to the driving unit so that a line speed of the nip section of the fixing roller pair is substantially equal to a line speed of the photosensitive body, wherein when the printing starts, the control unit controls the rotating speed applied to the driving unit so that the rotating speed applied to the driving unit substantially corresponds to the line speed of the photosensitive body, and after a predetermined number of pages of the image recording members have been printed and when a width or a length of the size of the image recording member to be used and recorded in the recording unit is greater than a width or a length, respectively, of a predetermined size of the image recording member, the rotating speed applied to the driving unit is controlled so that the line speed of the nip section between the heating roller and the pressing roller is changed to a second line speed which is slower than the line speed of the photosensitive body.

4. The image forming apparatus according to claim 1, wherein a curved portion of the downstream end of the guiding surface of the fixing device introduction guide member has a concave shape.

5. An image forming apparatus, comprising:

a photosensitive body;

a transferring device configured to transfer a toner image developed on the photosensitive body onto an image recording member;

a fixing device including a heating roller and a pressing roller, the fixing device configured to fix the toner image transferred on the image recording member onto the image recording member by heating and pressing; and a fixing device introduction guide member configured to guide the image recording member to a nip section between the heating roller and the pressing roller of the fixing device, wherein the fixing device introduction guide member is disposed close to the upstream side of the heating roller and the pressing roller and on the pressing roller side, a downstream end of a guiding surface of the fixing device introduction guide member in a feeding direction of the image recording member is disposed on the heating roller side with respect to a nip surface orthogonal to a straight line between the center of the heating roller and the center of the pressing roller, the nip surface including the nip section between the heating roller and the pressing roller, so that a downstream end of the image recording member guided by the fixing device introduction guide member first contacts the heating roller, the downstream end of the guiding surface of the fixing device introduction guide member is curved so that, with respect to both lateral ends of the downstream end of the guiding surface of the fixing device introduction guide member, a center portion of the downstream end of the fixing device introduction guide member is disposed on the pressing roller side, and the downstream end of the guiding surface of the fixing device introduction guide member is a single continuous curve between the both lateral ends of the downstream end of the guiding surface of the fixing device introduction guide member.

6. The image forming apparatus according to claim 5, further comprising:

a recording unit including at least one of a detecting unit configured to detect a sheet feeding tray and a size of the image recording member stacked in the sheet feeding tray and an input unit through which an operator inputs size data of the image recording member, and a rewritable memory configured to store the size data of the image recording member detected by the detection unit or input though the input unit;

a driving unit configured to drive a rotation of a fixing roller pair of the fixing device, the fixing roller pair including the heating roller and the pressing roller, the nip section being formed by pressing the heating roller with the pressing roller; and a control unit configured to control a rotating speed applied to the driving unit so that a line speed of the nip section of the fixing roller pair is substantially equal to a line speed of the photosensitive body, wherein when a width or a length of the size of the image recording member to be used and recorded in the recording unit is greater than a width or a length, respectively, of a predetermined size of the image recording member, the rotating speed applied to the driving unit is controlled so that the line speed of the nip section of the fixing roller pair is changed to a second line speed which is slower than the line speed of the photosensitive body.

7. The image forming apparatus according to claim 5, further comprising:

a recording unit including at least one of a detecting unit configured to detect a sheet feeding tray and a size of the image recording member stacked in the sheet feeding tray and an input unit through which an operator inputs size data of the image recording member, and a rewritable memory configured to store the size data of the image recording member detected by the detection unit or input though the input unit;

a counting unit configured to count a number of printed sheets after a printing starts;

a driving unit configured to drive a rotation of a fixing roller pair of the fixing device, the fixing roller pair including the heating roller and the pressing roller, the nip section being formed by pressing the heating roller with the pressing roller; and a control unit configured to control a rotating speed applied to the driving unit so that a line speed of the nip section of the fixing roller pair is substantially equal to a line speed of the photosensitive body, wherein when the printing starts, the control unit controls the rotating speed applied to the driving unit so that the rotating speed applied to the driving unit substantially corresponds to the line speed of the photosensitive body, and after a predetermined number of pages of the image recording members have been printed and when a width or a length of the size of the image recording member to be used and recorded in the recording unit is greater than a width or a length, respectively, of a predetermined size of the image recording member, the rotating speed applied to the driving unit is controlled so that the line speed of the nip section between the heating roller and the pressing roller is changed to a second line speed which is slower than the line speed of the photosensitive body.

8. The image forming apparatus according to claim 5, wherein a curved portion of the downstream end of the guiding surface of the fixing device introduction guide member has a concave shape.

* * * * *